United States Patent [19]

Wendler et al.

[11] 4,352,296

[45] Oct. 5, 1982

[54] CHATTER FREE GEAR DRIVEN CAM ACTUATED VACUUM PUMP

[75] Inventors: Paul O. Wendler, Saginaw; Donald L. Dzioba, Frankenmuth, both of Mich.

[73] Assignee: General Motors Corporation, Detroit, Mich.

[21] Appl. No.: 188,483

[22] Filed: Sep. 18, 1980

[51] Int. Cl.[3] ..... F16H 53/06; F16H 25/08

[52] U.S. Cl. ..... 74/55; 74/569

[58] Field of Search ..... 74/54, 55, 567, 569; 92/129

[56] References Cited

U.S. PATENT DOCUMENTS

| | | | |
|---|---|---|---|
| 1,404,183 | 1/1922 | Augustine . | |
| 1,598,839 | 9/1926 | Wills . | |
| 2,423,701 | 7/1947 | Hardy | 74/55 |
| 3,377,882 | 4/1968 | Schrempp | 74/567 |
| 3,543,589 | 12/1970 | Loughran, Jr. | 74/54 |
| 4,156,416 | 5/1979 | Weisgerber et al. | 123/196 R |

FOREIGN PATENT DOCUMENTS

| | | | |
|---|---|---|---|
| 601226 | 10/1934 | Fed. Rep. of Germany | 74/55 |
| 1007136 | 2/1952 | France | 74/55 |

*Primary Examiner*—Lawrence J. Staab

*Attorney, Agent, or Firm*—Robert J. Outland

[57] ABSTRACT

A vacuum pump having a cam actuated spring-biased pumping element and a gear for rotatably driving the cam has a torque counterbalancing spring and plunger device engaging the cam in a position out of phase with the pumping element and arranged to apply counterbalancing torques that prevent the application of torque reversals to the gear and thus avoid gear oscillation and chatter.

5 Claims, 5 Drawing Figures

CHATTER FREE GEAR DRIVEN CAM ACTUATED VACUUM PUMP

TECHNICAL FIELD

This invention relates to gear driven cam actuated vacuum pumps and, in particular, to means for providing chatter free operation of the gear drive mechanisms of such pumps.

BACKGROUND

It is known in the art to provide vacuum pumps for use with automotive vehicle engines and the like. Such pumps may be provided with a reciprocable pumping member actuated by a cam driven by a drive gear, all supported in a housing. The housing may be mountable in the engine block for engagement of the drive gear with a camshaft gear or other gear for driving the pump. Such an arrangement is shown, for example, in U.S. Pat. No. 4,156,416, granted May 29, 1979 and assigned to the assignee of the present invention. In this prior arrangement the drive gear drives an eccentric, or single lobed cam, that actuates the push rod of the pumping element, which is biased against the eccentric by a return spring.

While the foregoing construction is providing very satisfactory operation in commercial use, it was desired to provide an additional pump model with substantially increased pumping capacity at the same operating speeds. This was accomplished by substituting a three-lobed cam for the single eccentric of the previous embodiment, thus tripling its pumping rate. However, tests revealed that this change caused a significant problem of drive gear chatter, resulting in problems of excessive noise and gear wear during pump operation.

SUMMARY OF THE INVENTION

The present invention first involved the determination that the source of the problem lay in the increased rates of lift and decline of the three-lobed cam, together with the forces of vacuum and the return spring which hold the pumping member against the cam surface. This combination resulted in cyclic reversals of torque being applied to the gear and cam drive assembly during pump operation. That is, a torque applied in one direction during the working stroke of the pumping member was followed by a reversal of torque on the return stroke caused by the force of vacuum and the spring biased push rod acting against the cam and actually driving the cam and drive gear forward in their operating direction. The torque reversals caused oscillation of the cam and gear from their desired constant rotational speed which resulted in chatter or rattle of the gear against the teeth of the camshaft gear of the associated engine by the alternate taking up of the gear clearance in opposite directions.

It was considered that the forces acting on the pump drive were a combination of vacuum pumping forces, inertia of the reciprocating parts, force of the return spring and effective friction in the moving parts, and that alteration of one or more of these forces or modification of the cam contour might be effective to reduce or solve the gear chatter problem. For example, it would have been possible to increase friction in the drive mechanism so that it exceeded in magnitude the reverse torques created on the return stroke of the pumping mechanism, thus avoiding the oscillation and gear chatter problems. However such a solution would have resulted in a less efficient drive mechanism requiring additional power to overcome the increased friction and thus was considered undesirable.

The present invention involves a modification of the prior pump construction which provides the desired increased pumping capacity utilizing a high angle multi-loaded cam, together with a spring biased torque counterbalancing mechanism that eliminates gear chatter with a minimum increase in drive friction. The invention provides a housing mounted, spring biased plunger follower that engages the cam in a manner to provide balancing torque loadings phased generally in opposition to the driving torque loadings created by the vacuum pump push rod acting against the cam. The balancing torque loadings are preferably of a peak magnitude roughly equivalent to the reverse torques created on the pumping return strokes by the push rod driving the cam. Such an arrangement at least partially balances the torques applied to the drive cam and its associated drive gear. In this way the reversals of torque in the drive system are effectively reduced so that oscillation and chatter of the gear are avoided.

These and other features and advantages of the invention will be more fully understood from the following description of certain preferred embodiments taken together with the accompanying drawing.

BEST MODE DISCLOSURE

Figure 1:
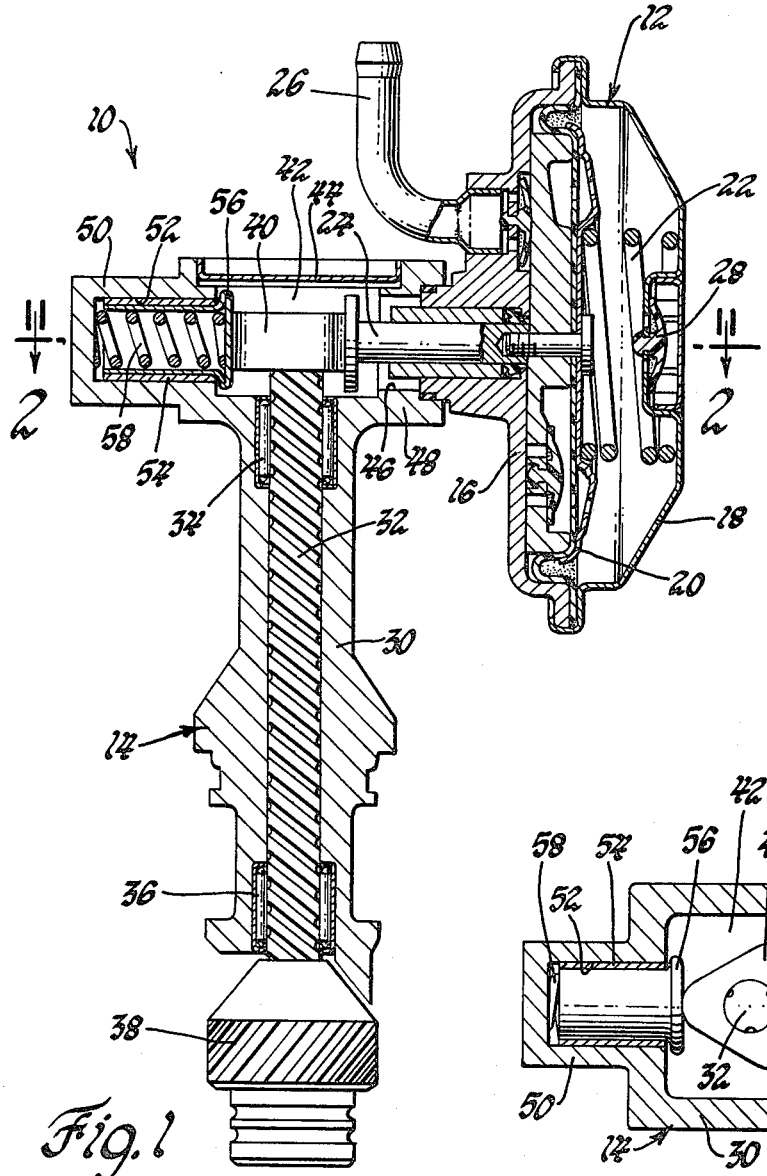
FIG. 1 is a cross-sectional view of a vacuum pump and drive assembly formed in accordance with the invention.
Figure 2:
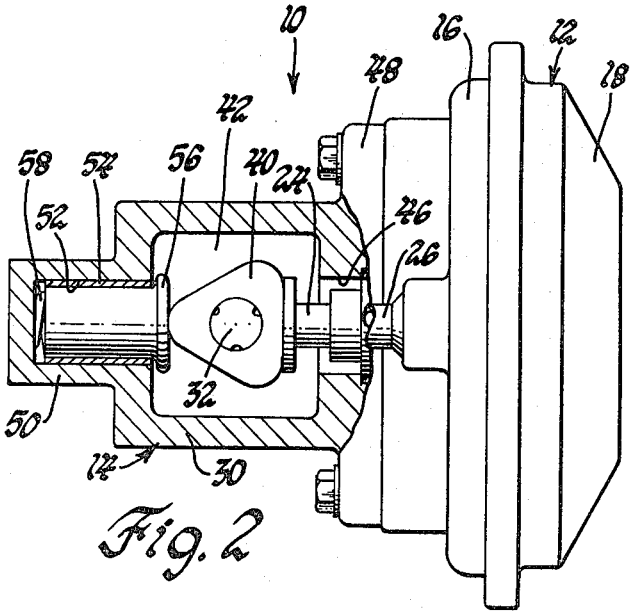
FIG. 2 is a top view of the assembly of FIG. 1 with portions in cross section to show the cam actuating and counterbalancing mechanism as seen from the plane indicated by the line 2—2 of FIG. 1.

Referring now to the drawing in detail numeral 10 generally indicates a vacuum pump and drive assembly formed in accordance with the invention. Assembly 10 includes two main components, a pump assembly 12 and a drive assembly 14 which supports the pump assembly and drives the pump. The combined assembly 10 is adapted to be installed in a suitable opening of an engine cylinder block, not shown, for driving engagement with a camshaft driving gear for purposes to be subsequently more fully described.

The construction of pump assembly 12 is essentially the same as that described in previously mentioned U.S. Pat. No. 4,156,416. For purposes of the present disclosure, it is sufficient to note that the major elements of the pump assembly are a base 16 with attached cover 18 enclosing a cavity containing a reciprocable diaphragm pumping member 20. The pumping member is biased leftwardly as shown in the drawing by a return spring 22 seated against the cover 18. A push rod 24 is operatively secured to the pumping member 20 and extends into the drive assembly to provide means by which the pumping member may be actuated as will be subsequently more fully described.

An air inlet 26 in the base and an outlet 28 in the cover provide access to the interior of the pump assembly and provide for the passage of air therethrough upon reciprocating pumping motion of the pump assembly so as to develop vacuum in an associated system connected with the air inlet 26. Further details of the construction may be obtained by reference to the disclosure of U.S. Pat. No. 4,156,416.

The drive assembly 14 includes an aluminum drive housing 30 that rotatably supports a drive shaft 32 on upper and lower needle bearings 34, 36, respectively. A drive gear 38 is securely mounted on the lower end of the drive shaft 32 while a tri-lobed drive cam 40 is fixed to the upper end of the shaft.

The drive housing 30 at its upper end defines an upwardly opening recess 42 containing the drive cam 40 and closed by a closure plate 44. An opening 46 leading from the recess 42 extends through a wall which defines a mounting boss 48 on which the pump assembly 12 is supported. The push rod 24 extends through the opening 46 to engage the tri-lobed surface of the drive cam 40. Additional features of the drive housing assembly not heretofore or subsequently described are preferably similar in construction to those of the mounting and drive assembly 22 described in the previously mentioned U.S. Pat. No. 4,156,416.

In addition to the three-lobed cam construction which provides three pumping reciprocations of the vacuum pumping member 20 for each rotation of the drive shaft 32, the construction of the present invention differs from that of the previously mentioned patent in its provision in the upper drive housing of a projection 50 on the wall of recess 42 opposite the mounting boss 48 on which the pump assembly 12 is mounted. Within the projection 50 is a cylindrical recess 52 which axially aligns with the opening 46 in the opposite wall so that the recess 52 and opening 46 may be machined together for ease of manufacture. A bearing bushing 54 is press fitted in the recess 52 and slidably receives a hollow reciprocable plunger 56 biased by a balance spring 58 rightwardly, as shown in the drawing, into engagement with three-lobed cam at a location radially opposite the engagement with the cam of the push rod 24 that actuates the vacuum pump member 20.

In use the pump and drive assembly is installed in a suitable opening in the engine block or other component of an engine. The drive gear 38 is disposed in engagement with a driving gear provided on the engine camshaft or other suitable component for rotatably driving the drive shaft 32 whenever the engine is operating. Rotation of the drive shaft and its attached cam 40 causes reciprocation of the push rod 24 and its attached pumping member 20, pumping air from the inlet 26 to the outlet 28 three times each rotational cycle of the drive shaft and creating a vacuum in an associated system connected with the inlet 26.

Because of the relatively high slope of the lobes of the cam 40, the vacuum force acting on pump member 20 and the force of the return spring 22 which urges the pumping member leftwardly into engagement with the cam, the interaction of the cam rotation with the pump push rod results in a substantial torque variation. This variation creates opposite torque loadings on the drive shaft that would be capable of causing torque reversals and resultant chatter-causing oscillation of the driving gear were it not for the inclusion in the structure of the torque counterbalancing mechanism comprised of plunger 56 and balance spring 58 received in bushing 54 and recess 52 of the drive housing 30. This counterbalancing mechanism applies torque loadings to the cam surface which are phased in generally opposite sense to the torque load applied via the push rod by the vacuum force and spring of the vacuum pump. Preferably, the biasing force of the spring 58 is selected to apply peak balancing torque loads to the cam approximately equal to the peak reverse torques applied through the push rod on the drive cam. Thus the torque loads applied by the two opposing mechanisms tend to balance or offset one another so that reverse torques applied to the drive shaft do not exceed the inherent friction forces of the drive system. Thus the resultant torque in the drive shaft remains essentially in a single direction and chatter-causing oscillation of the drive gear is avoided.

Figure 3:
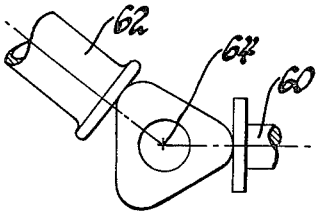
FIGS. 3, 4 and 5 are diagrammatic views illustrating various alternative locations for the torque balancing mechanism of the invention.
Figure 4:
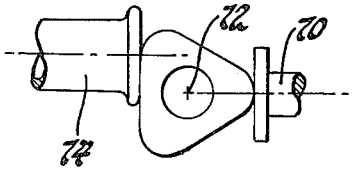
Figure 5:
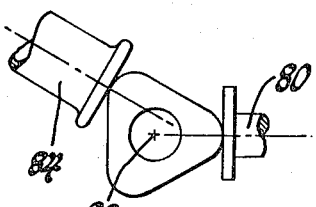

Since, as was previously mentioned, the forces applied to the drive cam are determined by a number of factors, it is recognized that placement of the counterbalancing mechanism directly opposite the pump push rod in a cam drive mechanism having an odd number of lobes does not necessarily provide a complete balancing of torque variations acting upon the drive shaft. Thus it is recognized that additional smoothing of the torque curve may be possible by offsetting, more or less, the phasing of the torque counterbalancing mechanism from a position directly opposite to the phasing of the vacuum pump and its associated push rod. FIGS. 3, 4 and 5 of the drawings indicate somewhat diagrammatically certain alternative arrangements in which the plunger of the torque balancing mechanism is offset from a directly opposed phase position for the purpose of better balancing the torque loadings.

In FIG. 3 it will be noted that the pump push rod 60 and the counterbalancing plunger 62 are radially offset around the drive cam axis 64 from radially opposite positions. In FIG. 4, on the other hand, the pump push rod 70 radially intersects the axis 72 of the drive cam while the axis of the counterbalancing plunger 74 is parallel to and offset from the push rod axis. In FIG. 5, the axis of the pump push rod 80 is likewise radially aligned with the drive cam axis 82 whereas the counterbalancing plunger 84 has its axis both offset radially and nonparallel to the push rod axis. Those arrangements are merely exemplary of ways in which the position of the counterbalancing plunger mechanism may be modified to provide variations in the counterbalancing torques applied to the drive shaft so as to further smooth out the actual drive torque in a manner appropriate for individual situations. Of course, such constructions may unnecessarily complicate manufacturing and therefore, in particular situations, may not be considered appropriate or economically desirable.

It should be understood that while the invention has been described by reference to certain preferred embodiments chosen for purposes of illustration, numerous changes could be made in the various details illustrated without departing from the inventive concepts disclosed thereby. Accordingly it is intended that the invention not be limited to the illustrated constructions, but that it have the full scope permitted by the language of the following claims.

The embodiments of the invention in which an exclusive property or privilege is claimed are defined as follows:

1. A chatter free gear driven cam actuated vacuum pump having a housing supporting a drive shaft carrying a lobed cam and a drive gear for driving the cam, a vacuum pumping element driven by a push rod carried by the housing, a return spring biasing the push rod into engagement with the lobed cam for reciprocably moving the push rod and pumping element upon rotation of the cam, the rates of cam lift and return and the force of the return spring together with vacuum forces on the pumping element being sufficiently great to apply alternately opposite torque loadings on the drive shaft capable of creating in operation torque reversals and resultant chatter causing oscillation of the drive gear, and a torque counterbalancing mechanism carried in the housing and operative to apply to the drive shaft torque loadings opposed to those applied by the push rod, said counterbalancing mechanism comprising a plunger reciprocably carried in the housing and a balance spring biasing the plunger into engagement with the lobed cam at a position of cam motion phased in opposition to that of the push rod, the biasing force of the balance spring and the shape of the cam being such that the reverse torque loads applied to the drive shaft are reduced below a level capable of creating torque reversals and chatter causing oscillation of the drive gear.

2. The combination of claim 1 wherein said lobed cam includes an uneven number of driving lobes with contact surfaces facing radially away from the longitudinal drive shaft axis and said push rod and plunger are carried by the housing at radially opposite sides of the cam for reciprocation on a common axis normal to the drive shaft axis.

3. The combination of claim 2 wherein the lift and return rates of the cam lobes are substantially equal and the biasing force of the plunger balance spring is such as to apply peak balancing torques to the cam that are approximately equal to the peak reverse torques applied to the cam through the pump push rod.

4. The combination of claim 1 wherein said plunger and said push rod have axes offset from one another to vary the overall torque counterbalancing effect on the drive gear.

5. A chatter free gear driven cam actuated vacuum pump and drive assembly comprising a housing having a recess at one end and rotatably supporting a drive shaft carrying a lobed cam received in the housing recess for rotation therein with the drive shaft, and a drive gear carried on the drive shaft externally of the housing for engagement with an external driving gear for rotating the drive shaft, a vacuum pump assembly carried by the housing at one side of said recess, said housing having an opening on said one side, said opening receiving a push rod connected with said pump assembly and extending through said opening to engage said lobed cam for actuating a pumping member in the pump assembly, and a second recess in said housing extending laterally from said first recess at a point with respect to said lobed cam that is diametrically opposite the position of said push rod receiving opening, whereby said second recess and said opening are aligned and thus capable of being machined together for ease of manufacture, said second recess receiving a plunger and a return spring urging the plunger into engagement with said lobed cam to apply balancing torque loadings thereto which offset at least in part reverse torque loadings applied to the cam by said pump assembly through said push rod to reduce the combined reverse torque loads below a level capable of creating torque reversals and chatter-causing oscillation of the drive gear.

* * * * *